US008893878B2

(12) United States Patent
Sprouse

(10) Patent No.: US 8,893,878 B2
(45) Date of Patent: Nov. 25, 2014

(54) SCREW-FED PUMP SYSTEM

(75) Inventor: Kenneth M. Sprouse, Canoga Park, CA (US)

(73) Assignee: Aerojet Rocketdyne of DE, Inc., Canoga Park, CA (US)

( * ) Notice: Subject to any disclaimer, the term of this patent is extended or adjusted under 35 U.S.C. 154(b) by 405 days.

(21) Appl. No.: 13/171,904

(22) Filed: Jun. 29, 2011

(65) Prior Publication Data

US 2013/0001047 A1 Jan. 3, 2013

(51) Int. Cl.

| | |
|---|---|
| ***B65G 15/00*** | (2006.01) |
| ***C10J 3/30*** | (2006.01) |
| ***C10J 3/50*** | (2006.01) |
| ***C10J 3/78*** | (2006.01) |

(52) U.S. Cl.

CPC .... *C10J 3/30* (2013.01); *C10J 3/50* (2013.01); *C10J 3/78* (2013.01); *C10J 2200/156* (2013.01)

USPC ..... 198/626.1; 110/284; 110/108

(58) Field of Classification Search

USPC ..... 110/284, 273, 101 R, 105, 108; 198/626.1

See application file for complete search history.

(56) References Cited

U.S. PATENT DOCUMENTS

| | | | | |
|---|---|---|---|---|
| 1,882,608 | A * | 10/1932 | Howe | 222/611.1 |
| 1,888,237 | A * | 11/1932 | Mitchell | 198/566 |
| 2,292,650 | A * | 8/1942 | Oehler et al. | 460/97 |
| 2,562,427 | A * | 7/1951 | Hurter | 414/307 |
| 3,760,933 | A * | 9/1973 | Maldeis et al. | 239/650 |
| 4,033,514 | A * | 7/1977 | Weiss et al. | 239/662 |
| 4,467,910 | A * | 8/1984 | Siwersson et al. | 198/518 |
| 6,416,261 | B2 * | 7/2002 | Martin | 406/128 |
| 7,387,197 | B2 | 6/2008 | Sprouse et al. | |
| 7,717,046 | B2 | 5/2010 | Sprouse et al. | |
| 2003/0188956 | A1 * | 10/2003 | Lepage | 198/550.1 |

FOREIGN PATENT DOCUMENTS

| | | |
|---|---|---|
| CN | 101143649 | 3/2008 |

* cited by examiner

*Primary Examiner* — James R Bidwell
(74) *Attorney, Agent, or Firm* — Joel G. Landau

(57) ABSTRACT

A pump system includes a pump that includes a first belt and a second belt that are spaced apart from each other to provide generally straight sides of a passage there between. There is an inlet at one end of the passage and an outlet at an opposite end of the passage, with a passage length that extends between the inlet and the outlet. The passage defines a gap distance in a width direction between the straight sides at the passage inlet. A hopper includes an interior space that terminates at a mouth at the passage inlet. At least one screw is located within the interior space of the hopper and includes a screw diameter in the width direction that is less than or equal to the gap distance.

19 Claims, 1 Drawing Sheet

SCREW-FED PUMP SYSTEM

STATEMENT REGARDING FEDERALLY SPONSORED RESEARCH OR DEVELOPMENT

This invention was made with government support under contract number DE-FC26-04NT42237 awarded by U.S. Department of Energy. The government has certain rights in the invention.

BACKGROUND

This disclosure relates to pump systems, such as pump systems that are used to move particulate materials.

In coal gasification, particulate coal material is converted under high temperature and high pressure into a product gas, known as "syngas" or synthesized gas. The product gas typically includes a mixture of hydrogen, carbon monoxide and other constituents, from which the hydrogen may be separated and used for various purposes.

Moving the particulate coal material from an ambient pressure environment into the high pressure environment of the gasification system is one challenge in coal gasification. Typically, the gasification system includes an extrusion pump to move the particulate coal material into the high pressure environment.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION

Figure 1:
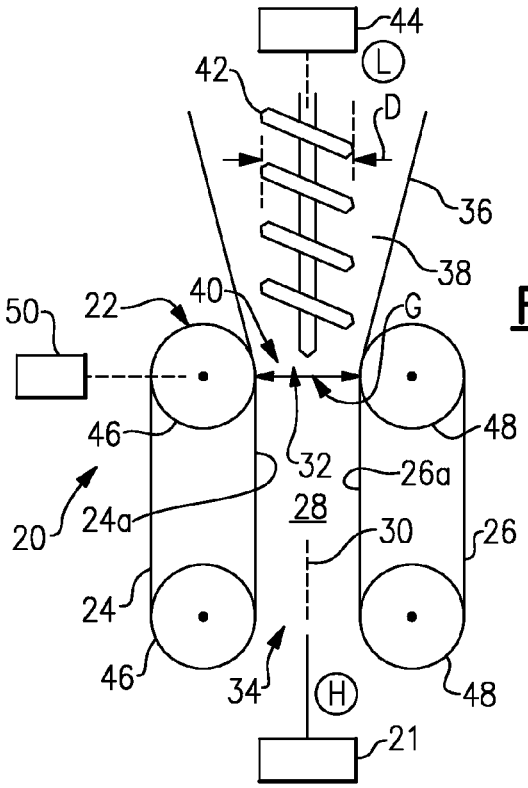
FIG. 1 shows an end view of an example pump system that includes a hopper and at least one screw within the hopper.
Figure 2:
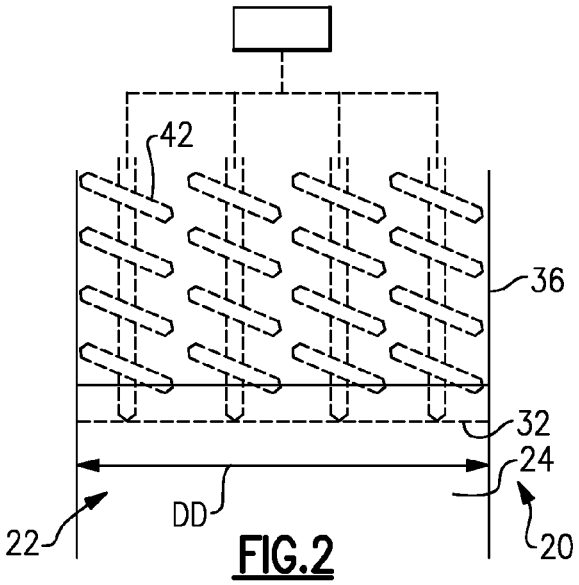
FIG. 2 shows a side view of the pump system of FIG. 1.

FIG. 1 schematically shows an end view of selected portions of an example pump system 20 that may be used to move a particulate material, such as particulate coal material. FIG. 2 shows a side view of selected portions of the pump system 20. For the purpose explaining the pump system 20, the pump system 20 is shown in an exemplary implementation with a gasification system 21 and arranged to move the particulate coal material from a low pressure environment (L) into a high pressure environment (H) of the gasification system 21. It is to be understood, however, that the disclosed example is not limited to the illustrated implementation.

As will be described, the pump system 20 moves, or extrudes, particulate coal material from the low pressure environment (L) to the high pressure environment (H) in a mechanically efficient manner while avoiding or reducing pressurization of the material and avoiding or reducing cavitation of the material. Over-pressurization of particulate coal can plug a pump and cavitation can lead to pressure release or coal blow-out through a pump.

The example pump system 20 includes a pump 22 that has a first belt 24 and a second belt 26 (hereafter belts 24 and 26) that are spaced apart from each other to provide a passage 28 there between. The passage 28 is elongated and extends longitudinally along a central axis 30 between an inlet 32 and an outlet 34 and laterally between a side 24*a* of the belt 24 and side 26*a* of the belt 26. The sides 24*a* and 26*a* refer to the generally linear lengths of the belts 24 and 26 that form side boundaries of the passage 28, through which the particulate coal material travels during the pumping operation. Although not shown, the passage 28 is also bounded by stationary side walls that, together with the sides 24*a* and 26*a*, circumscribe the passage 28.

The passage 28 defines a gap distance (G) in a width direction that is perpendicular to the central axis 30 between the sides 24*a* and 26*a* at the inlet 32. The inlet 32 is the farthest axial position of the passage 28 toward the hopper 36 at which the sides 24*a* and 26*a* are straight before the belts 24 and 26 curve around respective drive sprockets 46 and 48. In the illustrated example, the sides 24*a* and 26*a* are parallel such that the gap distance (G) is equivalent throughout the length of the passage 28. In other examples, the sides 24*a* and 26*b* may converge from the inlet 32 to the outlet 34 such that the gap distance (G) is largest at the inlet 32. The passage 28 also has a belt depth between edges of the belts 24 and 26 in a depth direction (see FIG. 2, DD) that is orthogonal to the width direction and the central axis 30. In the illustrated embodiment, the pump 22 has a ratio of the belt depth (DD) to the gap distance that, rounded to the nearest positive integer, equals 4.

A hopper 36 is arranged above the pump 22. The hopper 36 includes an interior space 38 that terminates at a mouth 40 to the inlet 32 of the passage 28. At least one screw 42 (hereafter "screw 42" refers to one or more screws) is located within the interior space 38 of the hopper 36. The screw flights are within the interior space 38, but other portions of the screw 42 may extend outside of the hopper 36. The screw 42 has a screw diameter (D) defined by the diameter of the screw flights. In this example, the pump system 20 is shown with four screws 42 that are arranged side-by-side in a row, and the central axes A of the screws 42 are parallel and non-coaxial. For efficient operation in the illustrated embodiment, the number of screws 42, rounded to the nearest positive integer, is equal to the belt depth (DD) divided by the gap distance (G). It is to be understood, however, that the pump system 20 may include less than four screws 42 or more than four screws 42, depending upon the size of the pump system 20. The screws 42 are operatively coupled with a drive mechanism 44 for rotating the screws 42 around central axis A at a desired speed.

The belt 24 wraps around a first set of the drive sprockets 46, and the belt 26 wraps around a second set of the drive sprockets 48. The drive sprockets 46, the drive sprockets 48 or both are operatively coupled with a drive mechanism 50 for rotating the drive sprockets 46, 48 to move the belts 24, 26. The belt 24 is driven in a clockwise direction and the belt 26 is driven in a counter-clockwise direction to move the particulate material through the passage 28. In other words, the belts 24, 26 are counter-rotated.

In the illustrated example, the screw diameter (D) is selected in accordance with the size of the inlet 32 of the passage 28. In one example, the screw diameter (D) is less than or equal to the gap distance (G). The screw diameter (D) may also be represented in a ratio to the gap distance (G). In one example, the ratio is 1. In other examples, the ratio is less than 1 and nominally may be 0.9, 0.8, or 0.5.

In operation, the particulate coal material is fed into the hopper 36. The drive mechanism 44 rotates the screw 42 to move the particulate material through the mouth 40 into the inlet 32 of the passage 28 of the pump 22. The belts 24 and 26 move the particulate material through the passage 28 and discharge the material through the outlet 34, into the high pressure environment (H) of the gasification system 21.

The screw 42 is designed to continually dispense the particulate material to the pump 22 at a velocity that is approximately equivalent (e.g., +/−10%) to the velocity of the belts 24 and 26, and avoid or reduce over-pressurization and cavitation. The screw 42 thereby functions as a metering device for delivering the particulate material into the pump 22, rather than as a compression device to shape, form or compact the particulate material.

The screw diameter (D), which is less than or equal to the gap distance (G), allows the pump system 20 to avoid over-pressurization and cavitation (i.e., the inability to maintain interparticle stress in the particulate coal material). By way of comparison, if the screw diameter (D) were larger than the gap distance (G), the screw 42 would elevate the bulk solids pressure of the particulate material in the hopper 36 to a level that would cause plugging. The stationary walls of the hopper 36 resist flow of the particulate material and, with even modest levels of bulk solids pressure above 10 psi (0.069 MPa), cause bridging rather than flow pumping. The bridging would cause the particulate material to plug the hopper 36 and simply rotate in unison with the screw 42 as one solid cylinder without any downward axial movement.

In another comparison, without the screw 42, the hopper 36 would not be able to deliver the particulate material at a high enough velocity to keep up with the velocity, and thus demand for material, of the belts 24 and 26. As an example, the mechanical efficiency at a belt speed of 0.7 feet per second would be less than 30%. The hopper 36 would also not provide any contact resistance between the particulate material and the belts 24 and 26 for the belts 24 and 26 to "grip" the material for intake into the pump 22. The slow delivery velocity and lack of contact resistance would result in cavitation.

Using the screw diameter (D) that is less than or equal to the gap distance (G) limits the bulk solids pressure of the particulate material at the mouth 40 to be no greater than 5 psi (0.034 MPa) and, in some examples, to be nominally less than 0.5 psi (0.0034 MPa). The low level of bulk solids pressure is enough to provide contact resistance with the belts 24 and 26, which allows the belts 24 and 26 to "grip" the particulate material for intake into the passage 28. Thus, the screw 42 is able to avoid over-pressurization and deliver the particulate material at a velocity that is approximately equivalent to the rate of the belts 24 and 26, which increases the mechanical efficiency of the pump 22. Additionally, the disclosed pump system 20 also allows the belts 24 and 26 to be operated at higher velocities, such as a velocity greater than 2.0 ft/s (0.610 m/s), because the screw 42 is able to deliver the particulate material without plugging or significant cavitation.

Figure 3:
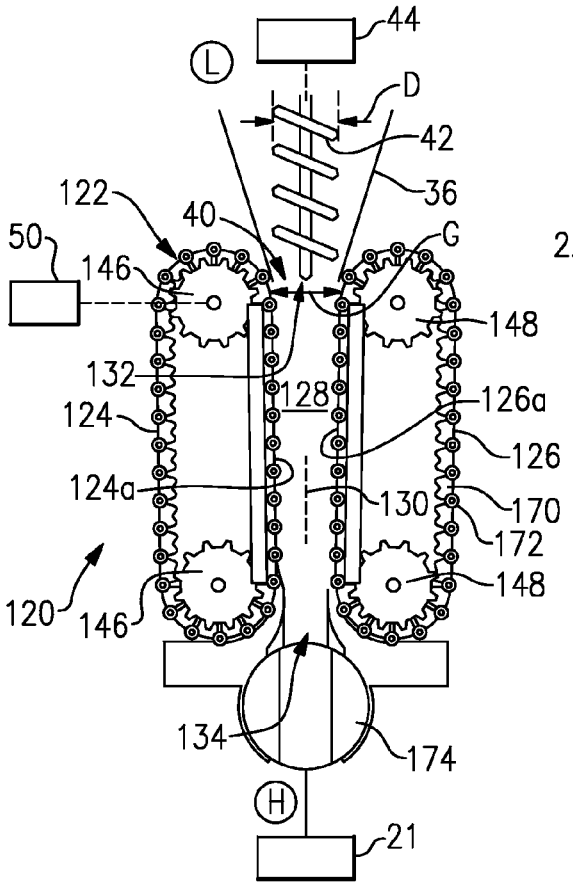
FIG. 3 shows another embodiment of a pump system that includes a hopper and at least one screw within the hopper.

FIG. 3 illustrates another embodiment of a pump system 120, where like reference numerals are used to indicate like elements, and reference numerals with the addition of one-hundred or multiples thereof designate modified elements. The like elements and modified elements are understood to incorporate the same features and benefits as the corresponding original elements.

In this example, the pump system 120 includes a pump 122 that has a first belt 124 and a second belt 126 (belts 124 and 126) that are spaced apart from each other to provide a passage 128 there between. The passage 128 extends longitudinally along a central axis 130 between an inlet 132 and an outlet 134 and laterally between a side 124*a* of the belt 124 and side 126*a* of the belt 126. The sides 124*a* and 126*a* refer to the generally linear length of the belts 124 and 126 that form side boundaries of the passage 128, through which the particulate coal material travels during the pumping operation. The passage 128 is also bounded by stationary side walls (not shown) that, together with the sides 124*a* and 126*a*, circumscribe the passage 128.

The inlet 132 is considered to be the farthest axial position of the passage 128 toward the hopper 36 at which the sides 124*a* and 126*a* are straight before the belts 124 and 126 curve around respective drive sprockets 146 and 148. In this example, the sides 124*a* and 126*a* converge from the inlet 132 to the outlet 134 such that the gap distance (G) is largest at the inlet 132.

The belt 124 and the belt 126 are segmented belts that each include belt links 170 that are pivotably connected together with linkages 172. The linkages 172 allow the belts 124 and 126 to travel in a curved path around respective sets of drive sprockets 146 and 148.

Similar to the arrangement shown in FIG. 1, the hopper 36 is arranged at the inlet 132 of the passage 128. The screw 42 has a screw diameter (D) that is less than or equal to in size to the gap dimension (G) of the inlet 132 of the pump 122, for delivering particulate material to the pump 122 as described with regard to FIGS. 1 and 2. The pump 122 extrudes the particulate material from the relatively low pressure environment (L), through a valve 174 out the outlet 134, and into the high pressure environment (H) of the gasification system 21.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A pump system comprising:

a pump including a first belt and a second belt that are spaced apart from each other to provide generally straight sides of a passage there between, with a passage length extending between an inlet at one end of the passage and an outlet at an opposite end of the passage, the passage defining a gap distance in a width direction between the straight sides at the passage inlet;

a hopper including an interior space that terminates at a mouth to the inlet; and at least one screw within the interior space of the hopper, and the at least one screw includes a screw diameter in the width direction that is less than or equal to the gap distance, wherein the screw is configured to meter a particulate for downward axial movement.

2. The pump system as recited in claim 1, wherein the passage extends along a central axis and the first belt and the second belt define a belt depth between edges of the belts in a depth direction that is orthogonal to the width direction and the central axis, and the at least one screw includes a number of screws that is equal to the belt depth divided by the gap distance, rounded to the nearest positive integer.

3. The pump system as recited in claim 1, wherein the passage extends along a central axis and the first belt and the second belt define a belt depth between edges of the belts in a depth direction that is orthogonal to the width direction and the central axis, and a ratio of the belt depth to the gap distance, rounded to the nearest positive integer, equals 4.

4. The pump system as recited in claim 1, wherein the at least one screw includes a plurality of screws that are arranged side-by-side in a row within the hopper.

5. The pump system as recited in claim 1, wherein the straight sides are parallel to each other.

6. The pump system as recited in claim 1, wherein the first belt and the second belt are segmented belts that each include belt links that are pivotably connected together with linkages.

7. The pump system as recited in claim 1, wherein the at least one screw is rotatable around an axis that is parallel to a central axis that extends between the inlet and the outlet of the passage.

8. The pump system as recited in claim 1, wherein the first belt and the second belt are counter-rotatable.

9. The pump system as recited in claim 1, including a pressurized system, relative to the pressure of the environment in the hopper, connected with the passage at the outlet.

10. The pump system as recited in claim 1, wherein the hopper includes hopper walls that converge at the mouth.

11. The pump system as recited in claim 1, wherein the first belt is mounted on a first set of drive sprockets and the second belt is mounted on a second set of drive sprockets.

12. A method of pumping, comprising:

feeding a particulate material into a hopper; and using at least one screw within the hopper to axially dispense the particulate material into an inlet of a passage of a pump, wherein the passage extends between a first moving belt and a second moving belt that are spaced apart from each other to provide generally straight sides of the passage there between, and wherein the passage extends along a central axis with a passage length between the inlet at one of the passage and an outlet at an opposite end of the passage, and the passage defines a gap distance in a width direction between the straight sides at the inlet, and the at least one screw includes a screw diameter in the width direction that is less than or equal to the gap distance.

13. The method as recited in claim 12, including using the at least one screw to feed the particulate material without pressurizing the particulate material above a pressure of 5 psi (0.034 megapascals).

14. The method as recited in claim 12, including continually dispensing the particulate material into the inlet of the passage at a velocity that is approximately equivalent to the velocity of the first moving belt and the second moving belt.

15. The method as recited in claim 14, wherein the velocity is at least 2.0 ft/s (0.610 m/s).

16. The pump system as recited in claim 1, wherein a ratio of the screw diameter to the gap distance is less than 1.

17. The pump system as recited in claim 1, further comprising a valve at the outlet of the passage.

18. The pump system as recited in claim 1, wherein the inlet is the farthest axial position of the passage toward the hopper at which the straight sides of the passage are straight before the first belt and the second belt curve around respective drive sprockets.

19. The pump system as recited in claim 1, wherein the at least one screw and the pump are configured such that the first belt and the second belt are operable to deliver particulate material at a belt velocity of greater than 2.0 ft/s (0.610 m/s) without plugging or cavitation of a particulate material.

* * * * *